US005975346A

United States Patent [19]

Imperato et al.

[11] Patent Number: 5,975,346

[45] Date of Patent: Nov. 2, 1999

[54] CONTAINER FOR PAINTS AND SIMILAR MATERIALS

[75] Inventors: Anthony Joseph Imperato, Purdys, N.Y.; Donna Elizabeth Ward, Upper Mount Claire, N.J.

[73] Assignee: The Sherwin-Williams Company, Cleveland, Ohio

[21] Appl. No.: 08/885,607

[22] Filed: Jun. 30, 1997

Related U.S. Application Data

[63] Continuation of application No. 08/163,103, Dec. 6, 1993, abandoned.

[51] Int. Cl.[6] ..... B65D 43/24; B65D 43/16

[52] U.S. Cl. ..... 220/831; 220/834; 220/840; 220/284; 220/698; 220/700; 220/697; 493/102; 493/85; 493/339; 53/452

[58] Field of Search ..... 220/254, 256, 220/259, 260, 284–286, 834, 831, 832, 836, 840–842, 695, 697, 698–701, 736, 735; 222/569, 570, 556; 264/500; 53/561, 452; 493/102, 104, 108, 85, 339

[56] References Cited

U.S. PATENT DOCUMENTS

| | | | |
|---|---|---|---|
| 1,012,390 | 12/1911 | Marles . | |
| 1,032,472 | 7/1912 | Downie . | |
| 1,589,872 | 6/1926 | Brunhoff . | |
| 1,661,243 | 3/1928 | Vessy . | |
| 1,710,288 | 4/1929 | Booth . | |
| 2,151,895 | 3/1939 | Carlson . | |
| 2,342,477 | 2/1944 | Magnenat . | |
| 2,418,502 | 4/1947 | Ferguson . | |
| 2,549,917 | 4/1951 | Milbrandt . | |
| 2,560,398 | 7/1951 | Tims | 220/90 |
| 2,626,081 | 1/1953 | Weed | 220/90 |
| 2,695,732 | 11/1954 | Tupper | 222/189 |
| 2,764,200 | 9/1956 | Gits | 220/254 |
| 2,873,052 | 2/1959 | Atherton | 222/570 |
| 2,885,108 | 5/1959 | Donoghue | 220/698 X |
| 2,889,087 | 6/1959 | Paull et al. | 220/834 X |
| 2,901,098 | 8/1959 | Tupper | 206/46 |
| 2,903,154 | 4/1959 | Hendershot | 220/698 X |
| 2,958,439 | 11/1960 | Yochem | 220/834 |
| 3,032,177 | 5/1962 | Majors | 220/736 X |
| 3,297,192 | 1/1967 | Swett | 220/840 |
| 3,329,307 | 7/1967 | Jacobson | 220/90 |
| 3,428,213 | 2/1969 | Stephens | 220/698 X |
| 3,469,735 | 9/1969 | Burt | 220/90 |
| 3,727,792 | 4/1973 | Levin | 220/90 |
| 3,744,671 | 7/1973 | Saunders, Jr. | 220/698 |
| 4,240,568 | 12/1980 | Pool | 222/570 X |
| 4,347,943 | 9/1982 | Hackwell et al. | 220/284 X |
| 4,349,120 | 9/1982 | DiNardo | 220/831 X |
| 4,687,200 | 8/1987 | Kreeger | 220/834 X |
| 4,724,979 | 2/1988 | Cleevely et al. | 220/339 X |

(List continued on next page.)

FOREIGN PATENT DOCUMENTS

| | | | |
|---|---|---|---|
| 370982 | 3/1990 | European Pat. Off. . | |
| 2235682 | 3/1991 | United Kingdom . | |
| 2251431 | 7/1992 | United Kingdom | 220/699 |
| PCT/DK89/ 00022 | 8/1989 | WIPO . | |

*Primary Examiner*—Stephen K. Cronin
*Assistant Examiner*—Nathan Newhouse
*Attorney, Agent, or Firm*—Heidi A. Boehlefeld; Robert E. McDonald; Vivien Y. Tsang

[57] ABSTRACT

A container for holding paint or other liquids and a method for making same. The container includes a body having a bottom wall and a side wall extending from the bottom wall along the periphery of the bottom wall which terminates in an upper rim. The container also includes an annular retaining ring secured to the upper rim. The annular retaining ring forms an outlet/inlet through which a liquid can be placed or removed from the container. The container further includes a lid pivotally and detachably mounted to the annular retaining ring for movement between an open position and closed position with respect to the outlet/inlet and for removing the lid from the annular retaining ring. The lid, body and annular retaining ring are individually molded and secured together by simple fastening means.

10 Claims, 5 Drawing Sheets

U.S. PATENT DOCUMENTS

| | | | |
|---|---|---|---|
| 4,809,874 | 3/1989 | Pehr | 220/338 |
| 4,991,730 | 2/1991 | Pehr | 220/284 X |
| 5,048,715 | 9/1991 | Wolff | 220/335 |
| 5,108,029 | 4/1992 | Abrams et al. | 220/834 X |
| 5,242,074 | 9/1993 | Conway . | |
| 5,255,814 | 10/1993 | Delagera | 220/284 X |
| 5,312,001 | 5/1994 | Fischer | 220/834 X |
| 5,346,099 | 9/1994 | Salmon et al. | 220/832 X |
| 5,547,109 | 8/1996 | Robbins, III | 222/556 X |

CONTAINER FOR PAINTS AND SIMILAR MATERIALS

This is a continuation of copending application Ser. No. 08/163,103 filed on Dec. 6, 1993 now abandoned.

FIELD OF THE INVENTION

The present invention is directed to containers and more particularly to a container for holding paint and other similar like liquids.

BACKGROUND OF THE INVENTION

Typical prior art containers intended for holding paint and other similar-like liquids typically comprise a cylindrical metal can on which a press-on metal lid having an annular projection is placed into a mating annular groove on the upper rim of the can. The lid is typically removed by placing a screw driver or other similar tool between the lid and the can and prying the lid off the can. The lid is then removed and placed in an area separate from the can. The user may then take the paint and pour the contents into another container or simply using a brush or other similar-like tool to remove paint from the container.

In the typical use of a paint can, the brush is placed in the container to retain the desired amount of paint and the excess paint is wiped off the rim of the container. This causes paint to be trapped in the bottom of the groove in the rim of the container which, when solidified, will cause difficulty in the re-application or removal of the lid at some later time.

Another problem experienced with prior art paint containers is that as the user continues use of the container, the lid is stored at a location distant from the user thus making it extremely inconvenient for the user to go pick up the lid and close the can so as to allow moving of the container from place to place without spilling of the contents. Further, since the lid is typically distant from the user during use of the paint container, there is no convenient place to rest the brush during periods of non use, for example, during scraping or sanding of the object to be painted. This can be particularly troublesome when the user is in an awkward situation, such as on a ladder.

Applicants have invented an improved container that solves many problems of the prior art in a single design. A container made in accordance with the present invention allows the lid to be easily and conveniently carried with the base but also allows the container to be used in a manner that is typical of prior art containers. The lid is secured to the container in such a manner that the lid can be closed at any time so as to minimize spilling of the liquid contained therein. Additionally, means are provided for removing excess paint that may be on the brush and for storing of a brush during periods of non-use which minimizes spillage of paint in the area where the lid is secured to the base. The container is also designed so as to be economical to fabricate and easy to assemble.

SUMMARY OF THE INVENTION

In one aspect of the present invention there is provided a container for holding paint or other similar liquids, comprising:

a body comprising a bottom wall and a side wall extending from the bottom wall along the periphery of the bottom wall and terminating in an upper rim;

an annular retaining ring secured to the upper rim, the annular retaining ring forming an outlet;

a lid pivotally and detachably mounted to the annular retaining ring for movement between an open position and closed position with respect to the outlet and for removing the lid from the annular retaining ring.

In another aspect of the present invention there is provided a method for making a container for holding paint or other similar liquids, the container having a body comprising a bottom wall and a side wall extending from the bottom wall along the periphery of the bottom wall and terminating in an upper rim, an annular retaining ring secured to the upper rim, the annular retaining ring forming an outlet, and a lid pivotably and detachably mounted to the annular retaining ring for movement between an open position and closed position with respect to the outlet and for removing the lid from the annular retaining ring, comprising the steps of:

a. molding the body, annular retaining ring and lid of an appropriate plastic material;

b. securing the body and annular ring together; and c. securing the lid to the annular retaining ring.

DETAILED DESCRIPTION OF THE INVENTION

Figure 1:
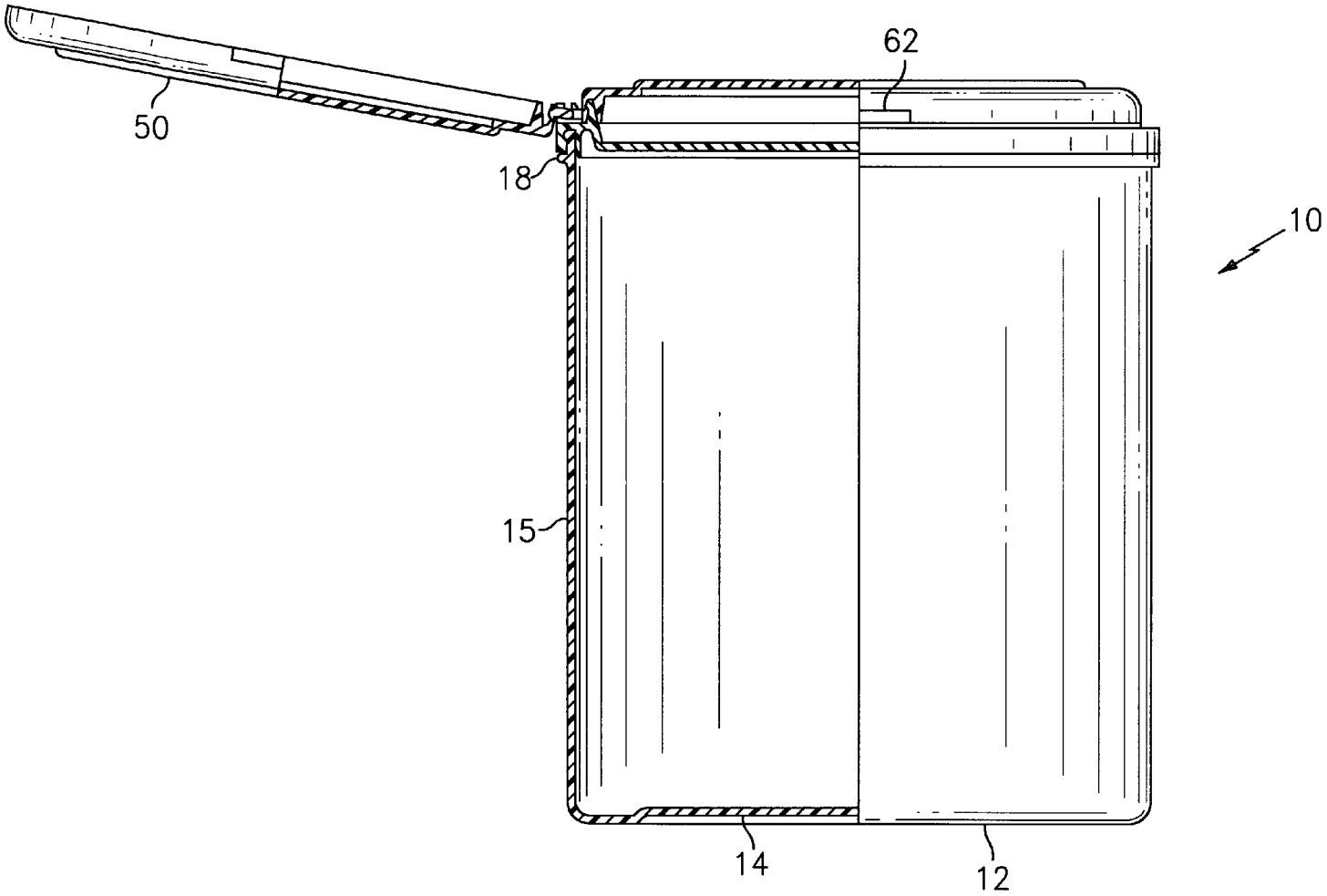
FIG. 1 is a front elevational view of a container made in accordance with the present invention partially broken away.
Figure 3:
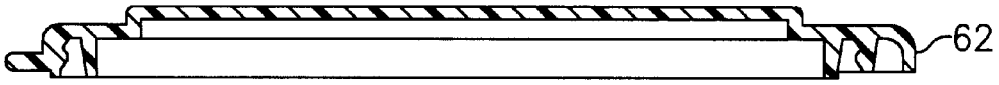
FIG. 3 is a cross-sectional view of the lid of the container of FIG. 3 as taken along line 3—3 of FIG. 2.
Figure 2:
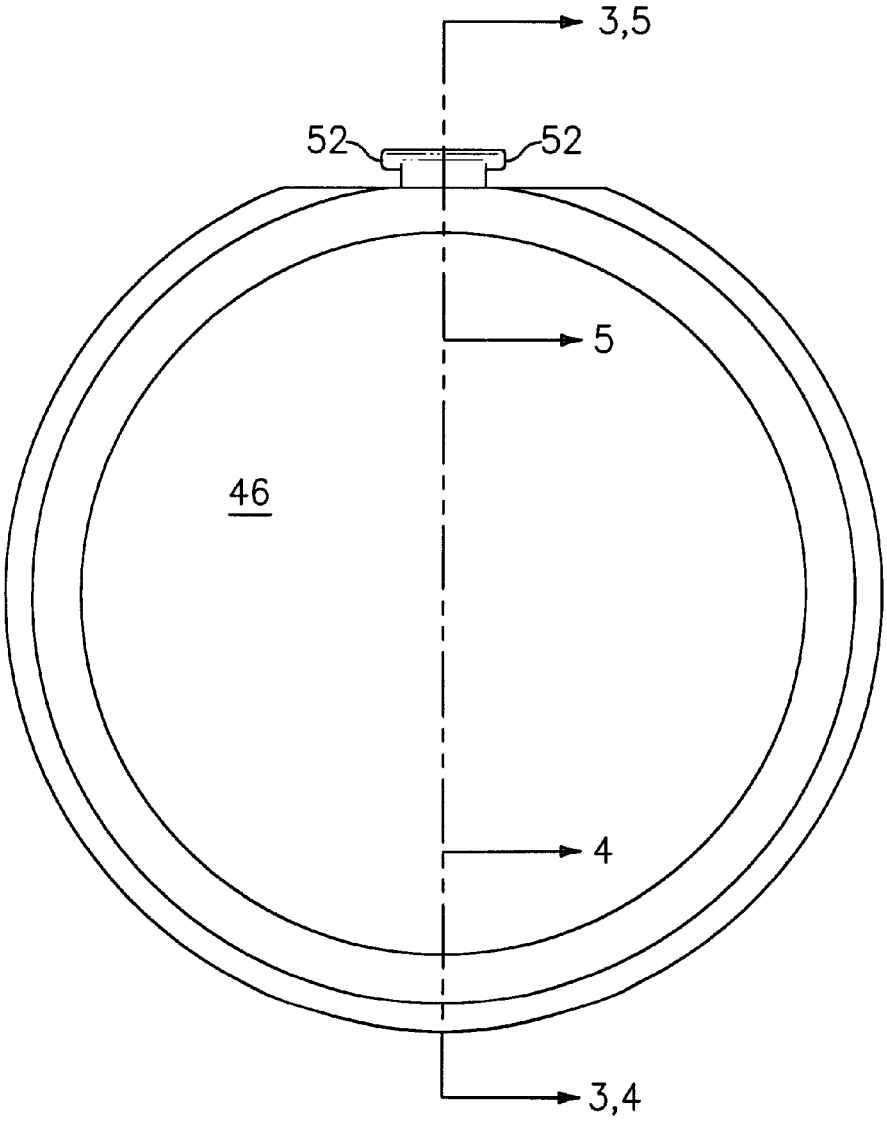
FIG. 2 is a top plan view of the lid of the container of FIG. 1.

Referring to the FIG. 1, there is illustrated a container assembly 10 made in accordance with the present invention. In particular, container assembly 10 comprises a body/base 12 having a bottom wall 14 and an upstanding peripheral side wall 15 which extends from the bottom wall 14 along the periphery of the bottom wall and terminates in an upper rim 18. The container assembly 10 also includes an annular retaining ring 20 which is secured to the upper rim 18. In the preferred embodiment illustrated, the body 12 and annular retaining ring 20 are made of an appropriate plastic material so that the parts can be easily and economically molded. The body 12 and annular retainer ring 20 are preferably made of an appropriate plastic material such as polyethylene or polypropylene capable of being molded. In the particular embodiment illustrated, the body 12 and annular retaining ring 20 are made of polyethylene and are made by mold injection. The annular retaining ring 20 may be secured to the body 12 in any desired manner. In the particular embodiment illustrated, the annular retainer ring 20 comprises a first annular projection 22 and a second downward extended annular projection 24 which are spaced apart so as to form a retaining recess 26 for receiving the upper rim 18. As illustrated in the preferred embodiment, the recess 26 and upper rim 18 are configured so as to provide a snap lock engagement. In particular, the recess 26 has a generally inverted L-shaped configuration which is designed to receive a mating projection 28 form on the upper rim 18. It is to be understood that the configuration of the projection 28, recess 26 and the selection of the material from which the body 12 and ring 20 are selected so as to provide a snap fit. It is to be understood that the annular retaining ring 20 and body 12 may be configured in any appropriately mating configuration and secured together in any appropriate manner, for example by a suitable adhesive.

The annular retaining ring 20 is designed and configured so as to provide means internally of the body 12 which can be used to remove excess paint from a brush as the brush is being withdrawn from the container. In the embodiment illustrated annular retaining ring 20 includes a downward extending annular projection 30 disposed radially inward of projection 24 which terminates into an annular wiping blade 32. While in the particular embodiment illustrated the wiping blade 32 extends 360° around the ring 20, the wiping blade 32 may extend any annular distance so desired. Additionally, the configuration of blade 32 may be modified to meet the requirements of the liquid placed therein.

Figure 6:
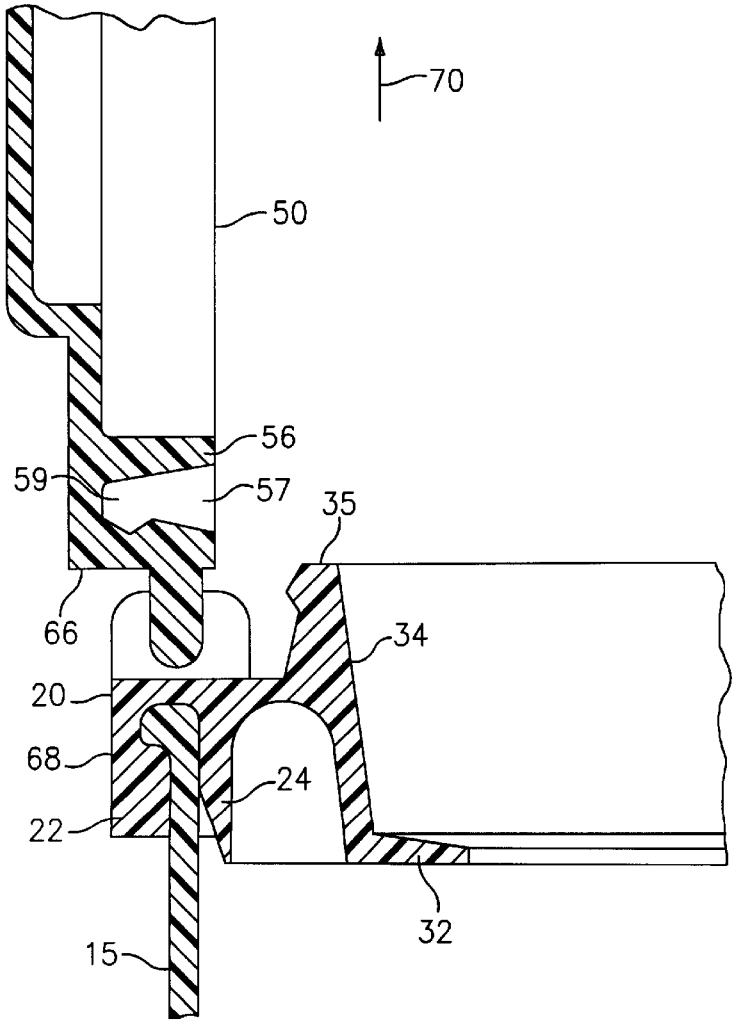
FIG. 6 is a view similar to FIG. 5 illustrating the lid in the partially opened position.
Figure 7:
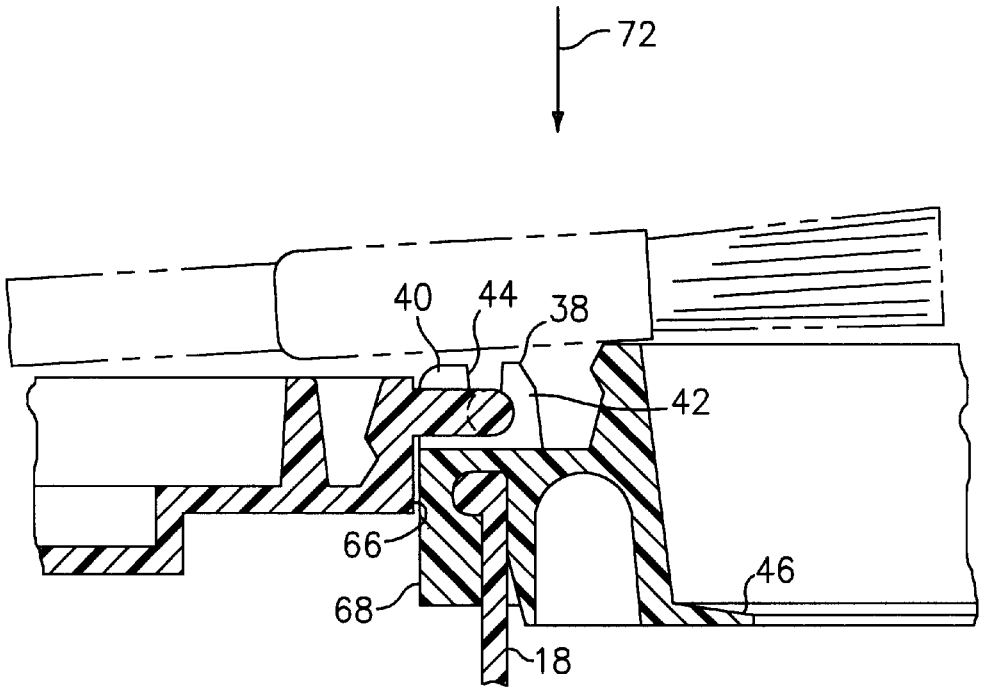
FIG. 7 is a view similar to FIG. 5 illustrating the lid in a fully extended open position.
Figure 5:
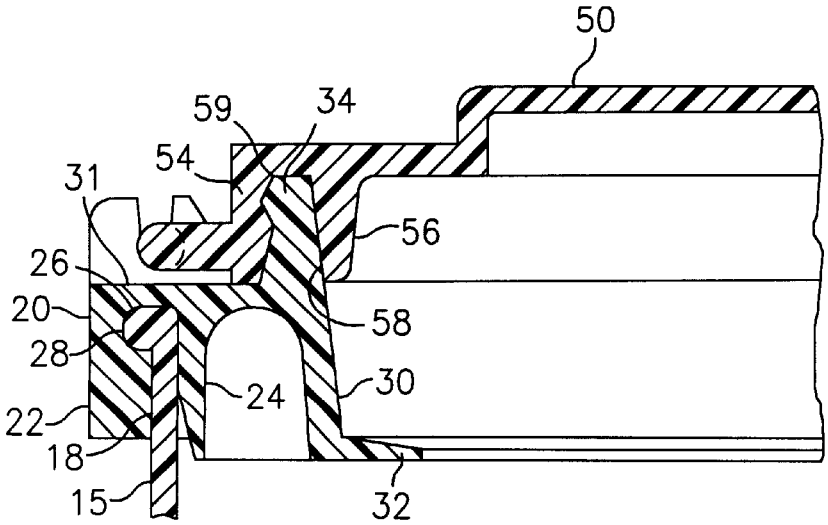
FIG. 5 is a partial cross-sectional view of the lid, retaining ring and base of the container of FIG. 1 as taken along the line 5—5 of FIG. 2.
Figure 8:
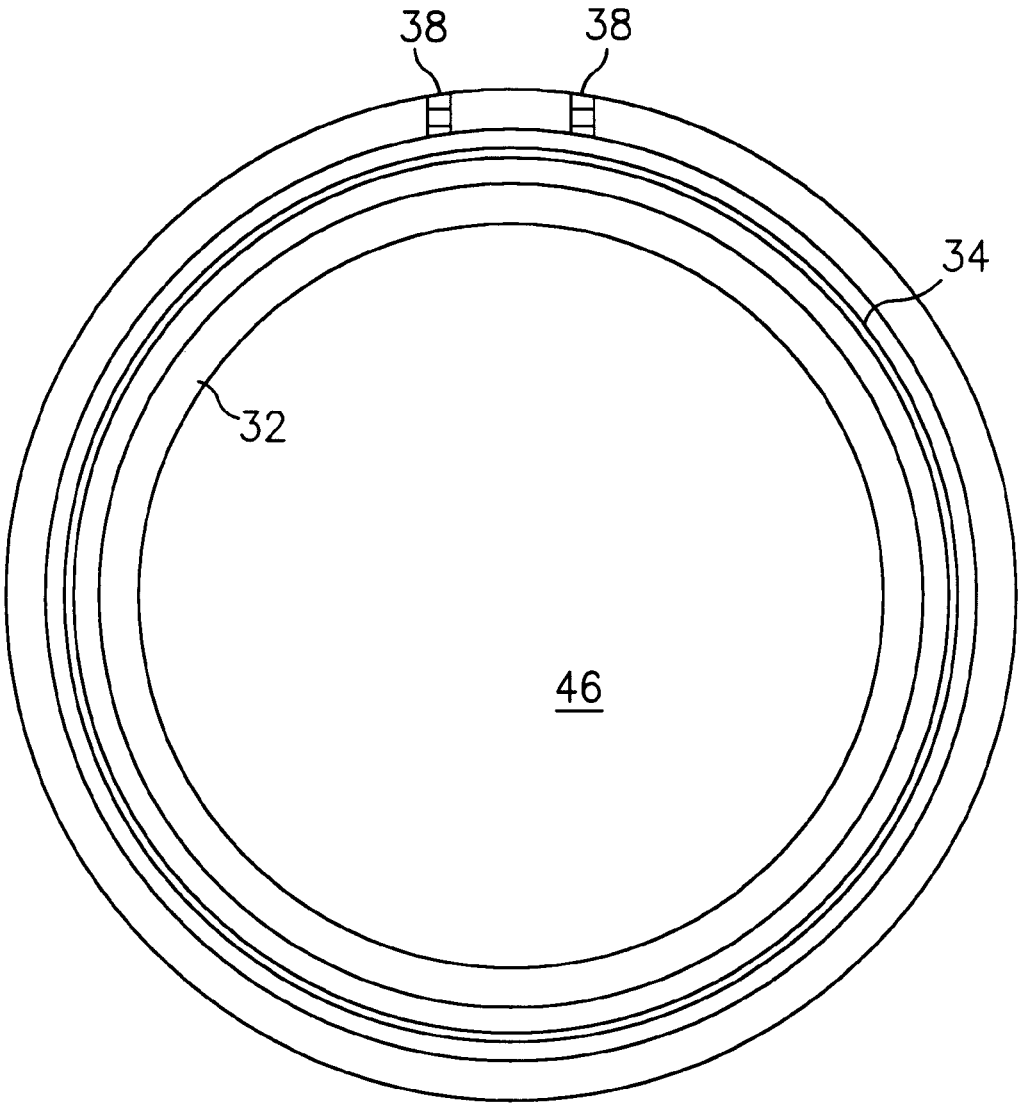
FIG. 8 is a top plan view of the annular ring of the container assembly of FIG. 1.

The annular retaining ring 20 further includes an upward extending sealing projection 34 and an annular surface 31 disposed radially outward of the sealing projection 34. As best seen in FIG. 8, the annular retaining ring 20 is provided with a pair of spaced retaining projections 38. Referring to FIGS. 5 through 7, each projection 38 comprises a pair of upstanding members 40, 42 which are shaped so as to provide a retaining recess 44. The recess 44 is shaped such that the lower portion has an enlarged substantially circular cross-sectional configuration and the upper section having a narrower width. The recess 44 is configured such that a pin, as is later described herein, can pass through the upper section of the recess and snap into position in the lower section so as to retain the pin. The annular ring 20 defines an opening 46 which allows access to the interior of the body 12 for filling and removing paint therefrom. For the purposes of the present invention the term paint shall include any paint and similar like liquids, for example, but not by way of limitation, stains, shellac, urethanes, oils, etc.

The container assembly further includes a lid 50 for closing of the container and providing a liquid tight seal there between. In particular, lid 50 is secured to the annular retaining ring 20 such that it can be pivoted for rotation between a closed position as illustrated in FIG. 5 and a fully open position as illustrated in FIG. 7. The lid 50 is also designed to be fully detached from the annular retaining ring 20. Thus allowing use of the container in a manner as any ordinary prior art container. The lid 50 includes a pair of mounting pins 52 which are designed to engage the recess 44 of the projections 38 formed on annular retaining ring 20. Thus, as illustrated in FIGS. 5 through 6, the lid 50 may be rotated from the closed position to the fully open position as illustrated in FIG. 7. The lid 50 includes a pair of radially spaced first and second annular walls 54, 56, respectively, which define a closure recess 57 for receiving sealing projection 34 so as to form a liquid tight seal there between. In particular, the first and second walls 54, 56 form a recess having a configuration designed to virtually engage the projection 34. In the particular embodiment illustrated, the projecting member has a bulbous upper end 35 which is designed to be received in the upper recess section 59 which is similarly configured. It is to be understood that various other configurations may be provided for the recess 58 and mating projection 34 as appropriate for providing a liquid tight seal. The lid 50 is preferably made of a plastic material, such as polyethylene or polypropylene, so that the lid 50 can also be easily made by conventional molding techniques. In the particular embodiment illustrated the lid 50 is made of polyethylene and is made by mold injection methods. Making of the lid 50 of an appropriate plastic material allows the first and second walls members to easily flex so as to make opening and closing of the lid 50 with respect to the annular retaining ring 20 easy while still providing a liquid tight seal when the lid 50 is in the closed position.

Figure 4:
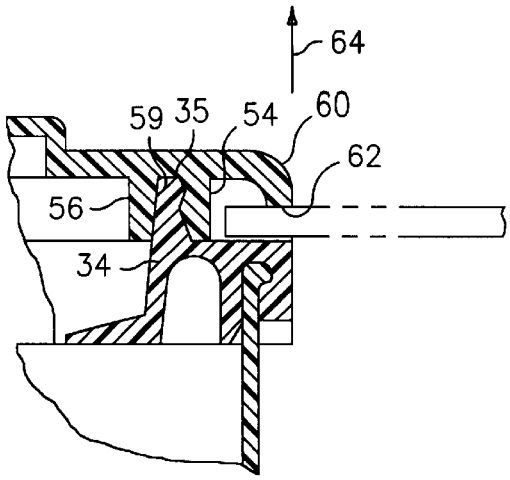
FIG. 4 is an enlarged partial cross-sectional view of the lid, retaining ring and base of the container of FIG. 1 as taken along line 4—4 of FIG. 2.

The lid 50 is also provided with a outer extending shield/projection which extends substantially around the lid except preferably in an area in which the mounting pins 52 are located. The projection 60 is provided with a plurality of cut-outs/slots 62 designed to receive a tool which allows opening of the lid 50 with respect to the annular retaining ring 20. As best illustrated in FIG. 4, a tool, such as screw driver, may be placed in the slot 62 so as to pry the lid 50 upward with respect to annular retaining ring 20, thus, causing disengagement of the projection 32 of the lid. As the lid 50 is moved upward as illustrated by arrow 64, the lid 50 is rotated about mounting pins 52 to the positions illustrated in FIGS. 6 and 7. FIG. 7 illustrates the lid 50 with a locking surface 66 which is shaped such that the lid 50 would be in a predetermined position such as illustrated in FIG. 7. The surface 66 mates with the outer surface 68 of the annular retaining ring 20 and firmly holds the lid 50 in the position illustrated. This allows a brush to be placed on the lid 50 so that the portion of the brush or other tool containing the paint extends over into the area defined by the body 12. Thus any excess paint that may drip from the brush will go directly into the container. This also allows to user to leave or do some other chore.

In order to remove the lid 50 from the container, the lid 50 is simply pulled in a direction as illustrated by arrow 70 in FIG. 6. Preferably as illustrated in FIG. 6, the lid 50 is rotated in a substantially vertical position and pulled upward. Due to the flexibility of the projections 38, the pins of the lid 50 will simply snap out. However, the projections 38 are such that when the lid 50 is in the fully opened position as illustrated in FIG. 7, the force of the weight of the brush will apply a force in the direction indicated by arrow 72 thus minimizing the possibility that the lid might accidentally disengaged from the mounting projections 38.

As previously discussed the body 12, retaining ring 20 and lid 50 are each made of an appropriate plastic material and made by conventional molding techniques. This allows for the easy and economical manufacture of these parts. The three part construction allows the container to be broken up into relatively simple design components, thus minimizing the mold cost for each. Because of the interlocking configurations of the parts, the element can be simply and easy assembled. The parts are first molded individually. The ring 20 is secured to the top of body 12, for example by a snap fit. The lid 50 is simply snapped onto the ring 20 by the pins 52 engaging the recesses 44. Alternatively, the lid 50 may first snap onto ring 20 and then the two assembled parts are secured to body 12. The container may be appropriately filled with an appropriate liquid either before or after the lid 50 has been placed on the body 12.

The present invention provides an improved container which allows the lid to be easily and conveniently carried with the base but also allows the container to be used in a manner that is typical of prior art containers. The lid is secured to the container in such a manner that the lid can be closed at any time so as to minimize spilling of the liquid contained therein. Additionally, means are provided for removing excess paint that may be on the brush and for storing of a brush during periods of non use which minimizes spillage of paint in the area where the lid is secured to the base. The container is also designed so as to be economical to fabricate and easy to assemble.

Parts List

10 . . . container assembly
12 . . . body/base
14 . . . bottom wall
15 . . . side wall
18 . . . upper rim
20 . . . retainer ring
22 . . . first annular projection
24 . . . downward extended annular projection
26 . . . retaining recess
28 . . . mating projection
30 . . . downward annular projection
31 . . . annular surface
32 . . . wiping blade
34 . . . sealing projection
35 . . . upper end
38 . . . spaced retaining projections
40,42 . . . upstanding members
44 . . . retaining recess
46 . . . opening
50 . . . lid
52 . . . mounting pins
54,56 . . . annular walls
57 . . . closure recess
58 . . . recess
60 . . . projection
62 . . . cut-outs/slots
64 . . . arrow
66 . . . surface
68 . . . outer surface
70,72 . . . arrows

What is claimed is:

1. A container for holding paint or other liquid coatings to be applied to a surface, comprising:

a body comprising a bottom wall and a side wall extending from said bottom wall and terminating in an upper rim;

an annular retaining ring secured to said upper rim, said annular retaining ring including an upwardly directed annular projection having an increased thickness in a portion thereof;

a lid pivotally and detachably mounted to said annular retaining ring for movement between an open position and a closed position with respect to said annular retaining ring, said lid having an annular recess therein with a configuration substantially complementary to the configuration of said upwardly directed annular projection on said annular retaining ring permitting said annular projection to be received within said annular recess when said lid is in said closed position;

wherein said lid is mounted to said annular retaining ring by means for mounting said lid permitting said lid to be pivotally moved from said open position to sad closed position and vice versa with respect to said annular retaining ring while preventing substantial angular rotation of said lid with respect to said annular retaining ring.

2. A container according to claim 1 wherein said annular retaining ring includes a wiping member integrally formed with said annular retaining ring and extending radially inwardly along said annular retaining ring.

3. A container according to claim 1 wherein said annular retaining ring includes means for securing said annular retaining ring to said body, said securing means comprising a first downwardly extending annular projection and a second downwardly extending annular projection spaced inwardly of said first downwardly extending annular projection so as to form an annular retaining recess therebetween for receiving said upper rim of said body.

4. A container according to claim 1 wherein said annular retaining ring and said lid are made of a plastic material permitting said annular retaining ring and said lid to each be molded as a single piece.

5. A container according to claim 1 wherein said body is substantially cylindrical in configuration and said bottom wall is substantially circular in configuration.

6. A container according to claim 1 wherein said annular retaining ring further includes an annular bearing surface disposed adjacent the periphery of said annular retaining ring and having a pair of upwardly directed mounting projections on said annular retaining ring, each of said mounting projections having a retaining recess therein.

7. A container according to claim 6 wherein said lid is provided with at least one pin for engagement with said retaining recesses in said upwardly directed mounting projections permitting said lid to be rotated with respect to said annular retaining ring between said open position and said closed position, said lid including means for positioning said lid in said open position with respect to said body, said positioning means comprising a bearing surface provided on the periphery of said lid which contacts said annular retaining ring for positioning said lid in said open position.

8. A container for holding paint or other liquid coatings to be applied to a surface, comprising:

a body comprising a bottom wall and a side wall extending from said bottom wall and terminating in an upper rim;

an annular retaining ring secured to said upper rim, said annular retaining ring including an upwardly directed annular projection having an increased thickness in a portion thereof and further including an annular bearing surface disposed adjacent the periphery of said annular retaining ring and having a pair of upwardly directed mounting projections on said annular retaining ring, each of said mounting projections having a retaining recess therein;

a lid pivotally and detachably mounted to said annular retaining ring for movement between an open position and a closed position with respect to said annular retaining ring, said lid having an annular recess therein with a configuration substantially complementary to the configuration of said upwardly directed annular projection on said annular retaining ring and having a closure skirt disposed radially outwardly along at least a portion of said lid, said closure skirt terminating in a lower rim portion adjacent said annular bearing surface of said annular retaining ring, said lower rim portion having at least one cutout section permitting a tool to be received in said cutout section between said lid and said bearing surface allowing said lid to be released from sealing engagement with said annular retaining ring;

wherein said lid is mounted to said annular ring by means for mounting said lid permitting said lid to be pivotally moved from said open position to said closed position and vice versa with respect to said annular retaining ring while preventing substantial angular rotation of said lid with respect to said annular retaining ring.

9. A method of making a container for holding paint or other liquid coatings to be applied to a surface, the container having a body comprising a bottom wall and a side wall extending from said bottom wall and terminating in an upper rim, an annular retaining ring secured to said upper rim, said annular retaining ring including an upwardly directed annular projection having an increased thickness in a portion thereof; and a lid pivotally and detachably mounted to said annular retaining ring for movement between an open position and a closed position with respect to said annular retaining ring, said lid having an annular recess therein with a configuration substantially complementary to the configuration of said upwardly directed annular projection on said annular retaining ring permitting said annular projection to be received within said annular recess when said lid is in said closed position, wherein said lid is mounted to said annular retaining ring by means for mounting said lid permitting said lid to be pivotally moved from said open position to said closed position and vice versa with respect to said annular retaining ring while preventing substantial angular rotation of said lid with respect to said annular retaining ring, comprising the steps of:

a. molding said body, said annular retaining ring and said lid of an appropriate plastic material;

b. securing said body and said annular retaining ring together; and c. securing said lid to said annular retaining ring.

10. A method of making a container with paint or other liquid coatings to be applied to a surface, the container having a body comprising a bottom wall and a side wall extending from said bottom wall and terminating in an upper rim, an annular retaining ring secured to said upper rim, said annular retaining ring including an upwardly directed annular projection having an increased thickness in a portion thereof; and a lid pivotally and detachably mounted to said annular retaining ring for movement between an open position and a closed position with respect to said annular retaining ring, said lid having an annular recess therein with a configuration substantially complementary to the configuration of said upwardly directed annular projection on said annular retaining ring permitting said annular projection to be received within said annular recess when said lid is in said closed position, wherein said lid is mounted to said annular retaining ring by means for mounting said lid permitting said lid to be pivotally moved from said open position to said closed position and vice versa with respect to said annular retaining ring while preventing substantial angular rotation of said lid with respect to said annular retaining ring, comprising the steps of:

a. molding said body, said annular ring, and said lid of an appropriate plastic material;

b. securing said lid and said annular retaining ring together; and c. securing said lid and said annular retaining ring to said body.

* * * * *